US006938789B1

(12) United States Patent
Matias et al.

(10) Patent No.: US 6,938,789 B1
(45) Date of Patent: Sep. 6, 2005

(54) COLLAPSIBLE STORAGE CONTAINER

(76) Inventors: Felix Matias, 2035 Marmion St. Apt 3-C, Bronx, NY (US) 10460; Ercilia Matias, 2035 Marmion Ave., New York, NY (US) 10460

( * ) Notice: Subject to any disclaimer, the term of this patent is extended or adjusted under 35 U.S.C. 154(b) by 152 days.

(21) Appl. No.: 10/392,717

(22) Filed: Mar. 20, 2003

(51) Int. Cl.[7] ..... B65D 8/14
(52) U.S. Cl. ..... 220/6
(58) Field of Search ..... 220/6, 7, 4.28

(56) References Cited

U.S. PATENT DOCUMENTS 1,335,137 A * 3/1920 Stubbs ..... 217/14
1,822,585 A * 9/1931 Douglas et al. ..... 217/14
5,458,255 A * 10/1995 Addeo et al. ..... 220/6

* cited by examiner

*Primary Examiner*—Joseph C. Merek

(57) ABSTRACT

A collapsible storage container made of a pair of foldable end panels, each comprising two panel pieces hingedly connected together. The end panels are connected with hinges to two side panels. At the bottom of each side panel a bottom panel is attached with hinges. This means that the collapsible storage container can be put in a usable "box" position by straightening the foldable end panels and folding down the bottom panels, and also can be put in a flat storage position by folding up the bottom panels and folding the foldable end panels until the outside surfaces of panel pieces touch each other.

15 Claims, 6 Drawing Sheets

COLLAPSIBLE STORAGE CONTAINER

BACKGROUND OF THE INVENTION

1. Field of the Invention

The present invention relates to a collapsible storage container for use in connection with storing and shipping a variety of materials, and folding the container for convenience and transportation when not in use. The collapsible storage container has particular utility in connection with folding hinged foldable end panels and foldable top and bottom panels to flatten the storage container, and locking the top and bottom panels in the in use position by engaging a peripheral lip on the end panels.

2. Description of the Prior Art

Collapsible storage containers are desirable storing and shipping materials of all kinds, and then collapsing the container to take as little space as possible when it is stored, shipped, or moved in the empty state.

The use of segmented storage containers is known in the prior art. For example, U.S. Pat. No. 3,746,242 to Troth discloses a combination folded container that is a combination of two separate pieces, one paper material and one plastic. The plastic piece is folded into a sleeve, and the paper piece is folded to form one end of the sleeve and to form a tuck flap. However, the Troth '242 patent does not disclose hinged foldable end panels, and has further drawbacks of separating the two pieces when they are folded down and stored, and of not providing a secure means for locking the bottom into place.

U.S. Pat. No. 5,704,487 to Taravella et al. discloses a shipping container that has a pallet held to the interior bottom of a box with flaps. However, the '487 patent does not does not disclose hinged foldable end panels, and has further drawbacks of separating the pallet from the box, or the container cannot be folded down and stored.

Lastly, U.S. Pat. No. 277,042 to Carter et al. discloses an ornamental design for a collapsible shipping container which has hinged sides that fold down over each other to collapse the container. However, the '042 patent does not disclose deployable floor panels which engage a peripheral lip to lock in place, and can not fold up to a smaller surface area than the size of the container floor.

While the above-described devices fulfill their respective, particular objectives and requirements, the aforementioned patents do not describe a collapsible storage container that allows folding hinged foldable end panels and foldable top and bottom panels to flatten the storage container, and locking the top and bottom panels in the in use position by engaging a peripheral lip on the end panels. The Troth patent makes no provision for hinged foldable end panels or a lip on the end walls to lock the bottom panels into place.

Therefore, a need exists for a new and improved collapsible storage container that can be used for folding hinged foldable end panels and foldable top and bottom panels to flatten the storage container, and locking the top and bottom panels in the in use position by engaging a peripheral lip on the end panels. In this regard, the present invention substantially fulfills this need. In this respect, the collapsible storage container according to the present invention substantially departs from the conventional concepts and designs of the prior art, and in doing so provides an apparatus primarily developed for the purpose of folding hinged foldable end panels and foldable top and bottom panels to flatten the storage container, and locking the top and bottom panels in the in use position by engaging a peripheral lip on the end panels.

SUMMARY OF THE INVENTION

In view of the foregoing disadvantages inherent in the known types of segmented storage containers now present in the prior art, the present invention provides an improved collapsible storage container, and overcomes the above-mentioned disadvantages and drawbacks of the prior art. As such, the general purpose of the present invention, which will be described subsequently in greater detail, is to provide a new and improved collapsible storage container which has all the advantages of the prior art mentioned heretofore and many novel features that result in a collapsible storage container which is not anticipated, rendered obvious, suggested, or even implied by the prior art, either alone or in any combination thereof.

To attain this, the present invention essentially comprises a collapsible storage container made of a pair of foldable end panels, each comprising two panel pieces hingedly connected together. The end panels are connected with hinges to two side panels. At the bottom of each side panel a bottom panel is attached with hinges. This means that the collapsible storage container can be put in a usable "box" position by straightening the foldable end panels and folding down the bottom panels, and also can be put in a flat storage position by folding up the bottom panels and folding the foldable end panels until the outside surfaces of panel pieces touch each other. The invention will usually include a top of some kind, which can be a pair of top panels, each one connected with hinges to the top of one of a side panel so that the box has two "lid flaps". Also, to hold the lid up and keep it from falling inside the container, a top panel retainer can be installed on the inside surface of each foldable end panel to catch the lid or lock it into place. Finally, the invention can include a peripheral lip on the on the inside of the end panels, toward the bottom, such that the peripheral lips support the bottom panels when the invention is in said usable "box" position.

There has thus been outlined, rather broadly, the more important features of the invention in order that the detailed description thereof that follows may be better understood and in order that the present contribution to the art may be better appreciated.

The invention may also include handle holes formed in each of said top panels or in any of the panels. Also, the top panel retainer can be formed of leaf springs, such that each spring will stick out of the end panels and support the top panels when the invention is in the usable position, and will move to a second position flush within a recess on the inside surface of the foldable end panels when the invention is in the flat storage position.

There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved collapsible storage container that has all of the advantages of the prior art segmented storage containers and none of the disadvantages.

It is another object of the present invention to provide a new and improved collapsible storage container that may be easily and efficiently manufactured and marketed.

An even further object of the present invention is to provide a new and improved collapsible storage container that has a low cost of manufacture with regard to both materials and labor, and which accordingly is then susceptible of low prices of sale to the consuming public, thereby making such collapsible storage container economically available to the buying public.

Still another object of the present invention is to provide a new collapsible storage container that provides in the apparatuses and methods of the prior art some of the advantages thereof, while simultaneously overcoming some of the disadvantages normally associated therewith.

Even still another object of the present invention is to provide a collapsible storage container for folding hinged foldable end panels and foldable top and bottom panels to flatten the storage container, and locking the top and bottom panels in the in use position by engaging a peripheral lip on the end panels. This allows a very durable, strong, and rigid container to be folded up and stored in a way similar to storing a cardboard box.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE PREFERRED EMBODIMENT

Figure 1:
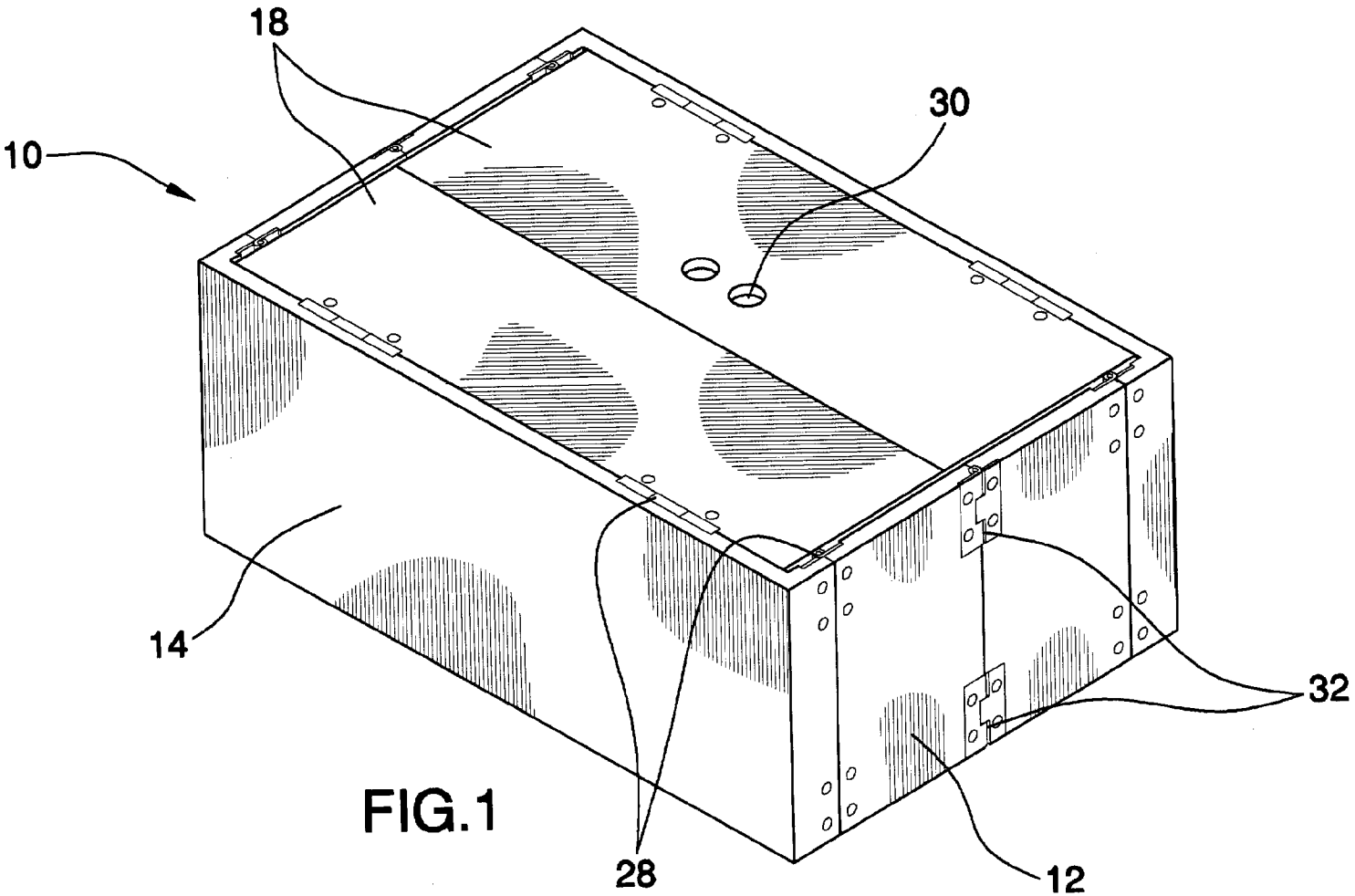
FIG. 1 is a perspective view of the preferred embodiment of the collapsible storage container constructed in accordance with the principles of the present invention.

Referring now to the drawings, and particularly to FIGS. 1, 2, 3, and 5, a present preferred embodiment of the collapsible storage container of the present invention is shown and generally designated by the reference numeral 10.

In FIG. 1, a new and improved collapsible storage container 10 of the present invention for folding hinged foldable end panels and foldable top and bottom panels to flatten the storage container, and locking the top and bottom panels in the in use position by engaging a peripheral lip on the end panels is illustrated from a perspective view and will be described. More particularly, the collapsible storage container 10 has a pair of foldable end panels 12, each panel consisting of two plastic panel pieces hingedly connected together with end panel hinges 32. These hinged connections provide the ability to fold the end panel inward and collapse the container flat. Two plastic side panels 14 are hingedly connected to the foldable end panels 12 with connecting hinges 28. Please note that the hinged connections can be formed by many different materials, or even a more pliable region of the same plastic material used for the panels. Two plastic top panels 18 are hingedly connected to the side panels 14, providing the ability for the top panels to fold inside of the container when it is changed to the flat storage position.

Figure 2:
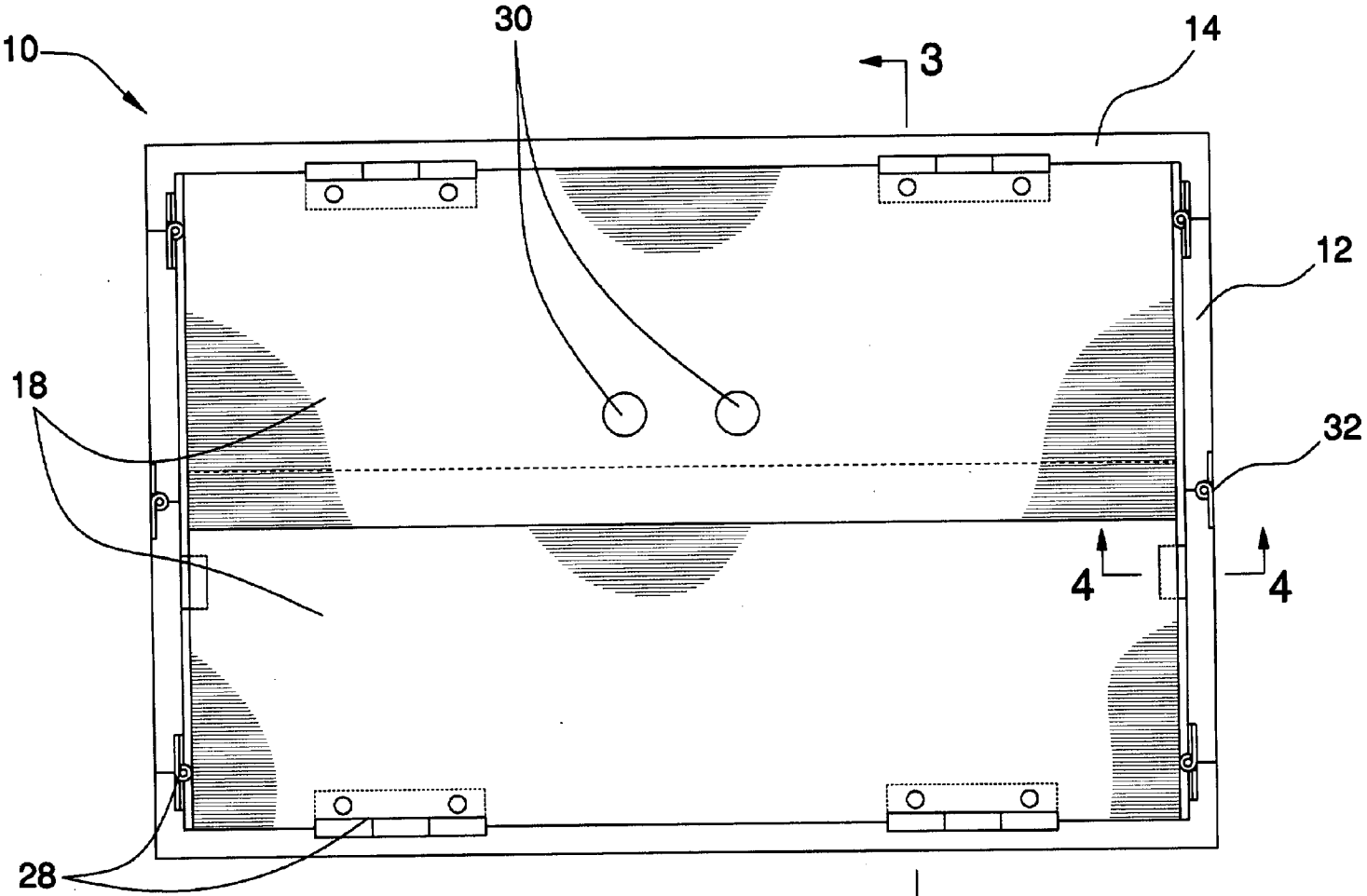
FIG. 2 is a top view of the collapsible storage container of the present invention.

Proceeding to FIG. 2, a top view of the present embodiment of the invention is shown, having two top panels 18 with handle holes 30 formed in the surface of one. Here one can see that the side panels 14 are formed with a right angle portions at the end to provide for a fit when the panels are folded together.

Figure 3:
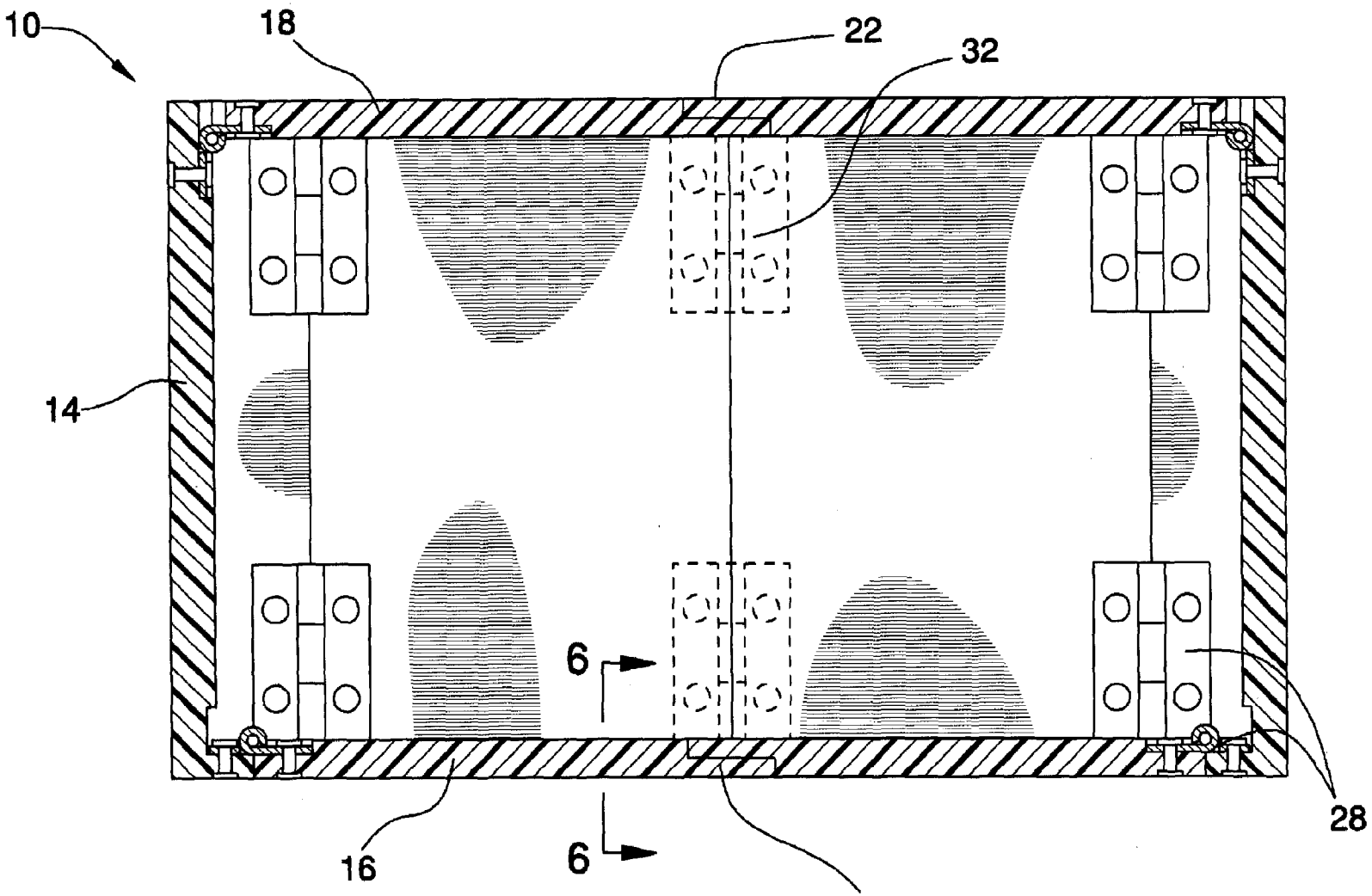
FIG. 3 is a cross sectional view of the collapsible storage container of the present invention taken along the line 3—3 in FIG. 2.

Referring now to FIG. 3, which is taken along the line 3—3 in FIG. 2, a cross sectional view of the present embodiment of the invention is shown. The top upper and lower tongues 22 that form the end of the top panels 18 can be seen. These tongues provide a solid fit to hold the top shut and can be made with a tongue/groove or a snapping connection of some kind to seal the container shut when closed. At the bottoms of the side panels, the two bottom panels 16 are hingedly connected. The bottom upper and lower tongues 24 can be seen at the end of the bottom panels 16. These tongues distribute the load on the seam between the bottom panels 16 across a larger area and thereby strengthen the bottom of the container.

Figure 4:
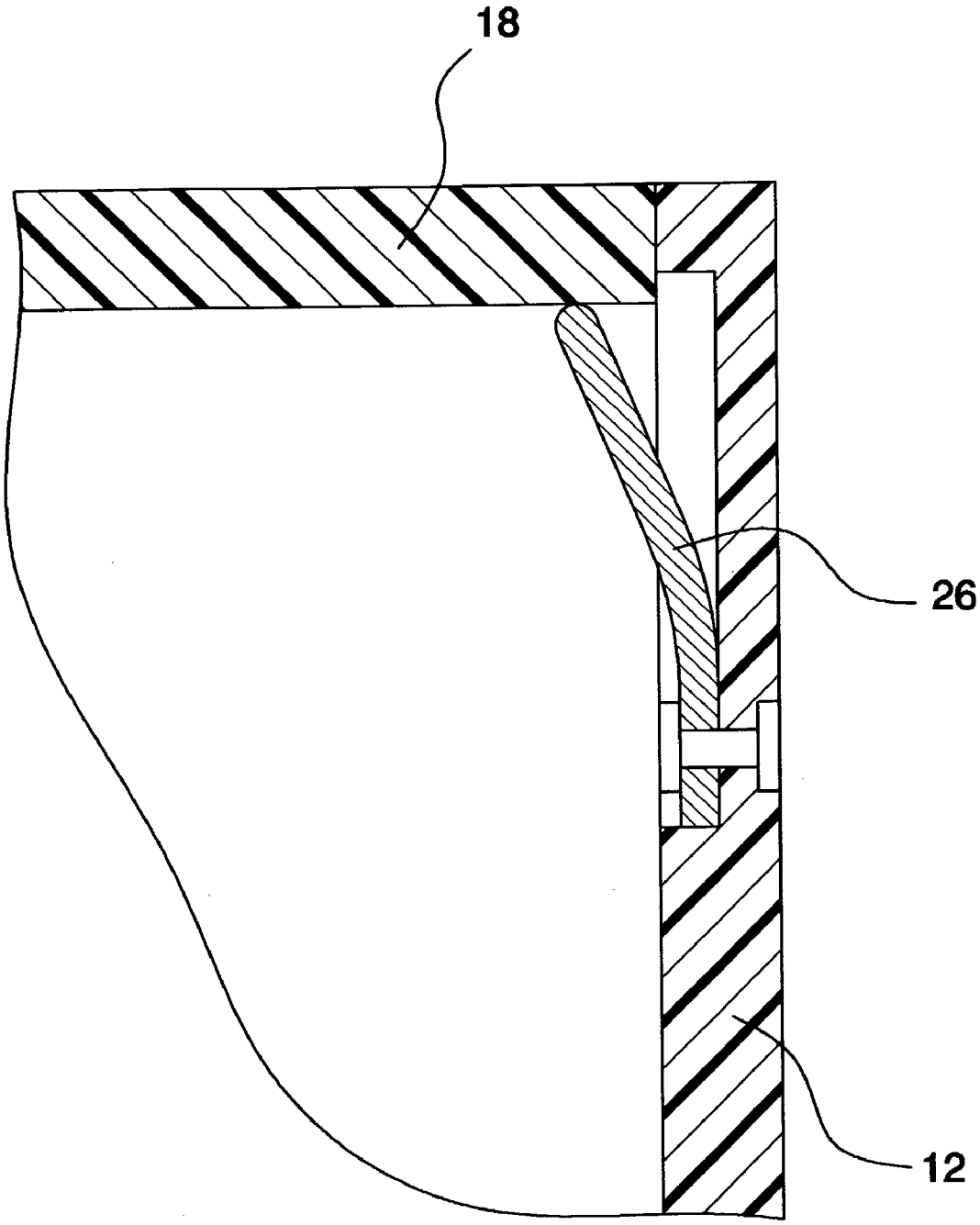
FIG. 4 is a close up cross sectional view of the collapsible storage container of the present invention taken along the line 4—4 in FIG. 2.

Referring next to FIG. 4, a cross sectional view of the top portion of the foldable end panels 12 is shown. The panels 12 are provided with a top panel retainer 26 to support the top panels 18 when they are in the closed position. This retainer 26 can be in the form of a leaf spring as shown here, and the spring would be forced back into a recess when the invention is folded up in the flat position.

Figure 5:
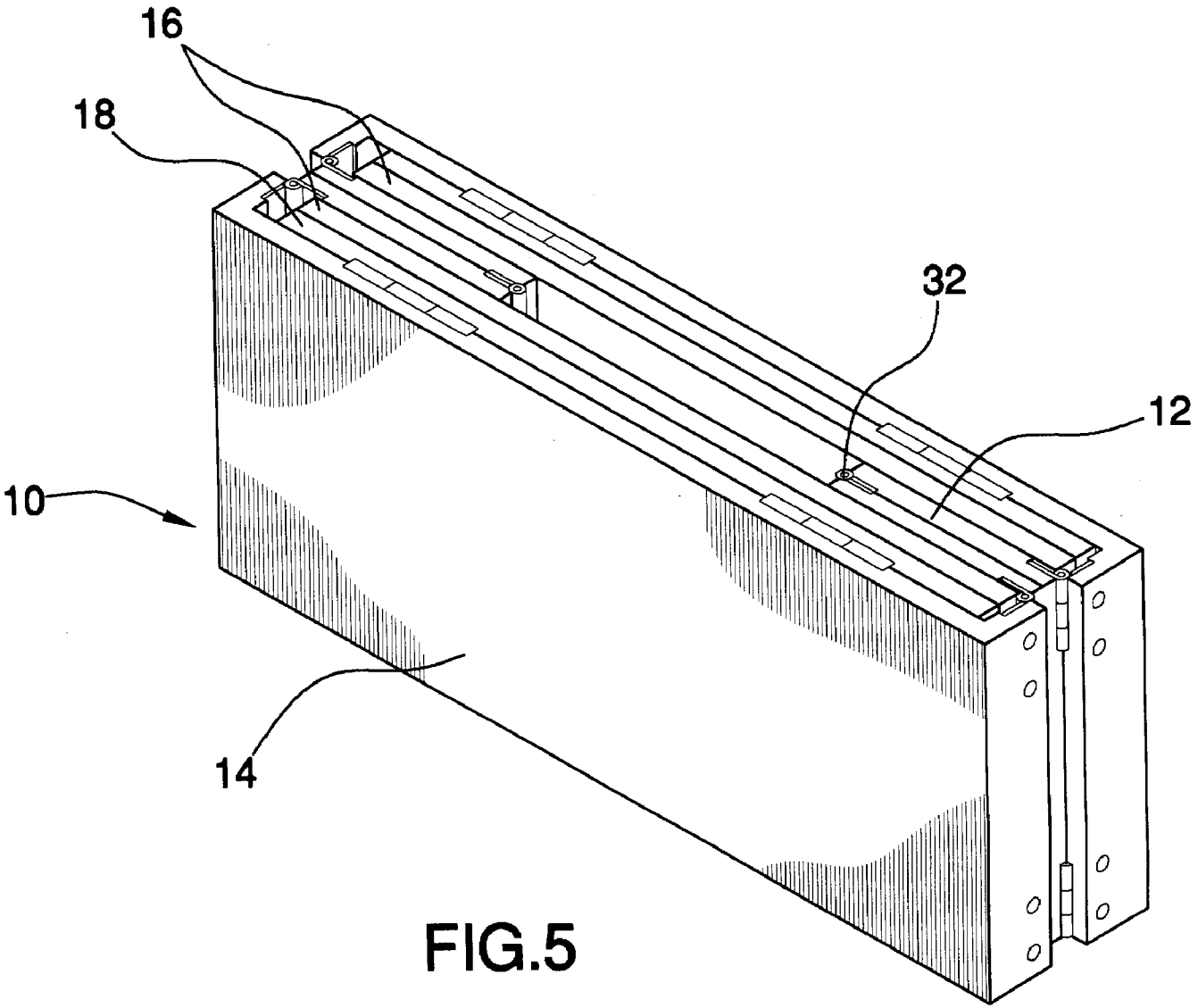
FIG. 5 is a perspective view of the collapsible storage container of the present invention in the flat storage position.

Referring now to FIG. 5, where a perspective view of the invention is shown in the folded flat position for storage and transportation. The foldable end panels 12 can be seen folded up in the middle of the invention. Moving out from the middle next the edges of the bottom panels 16 can be seen, followed by the edges of the top panels 18, and then the side panels 14 finally at the outside.

Figure 6:
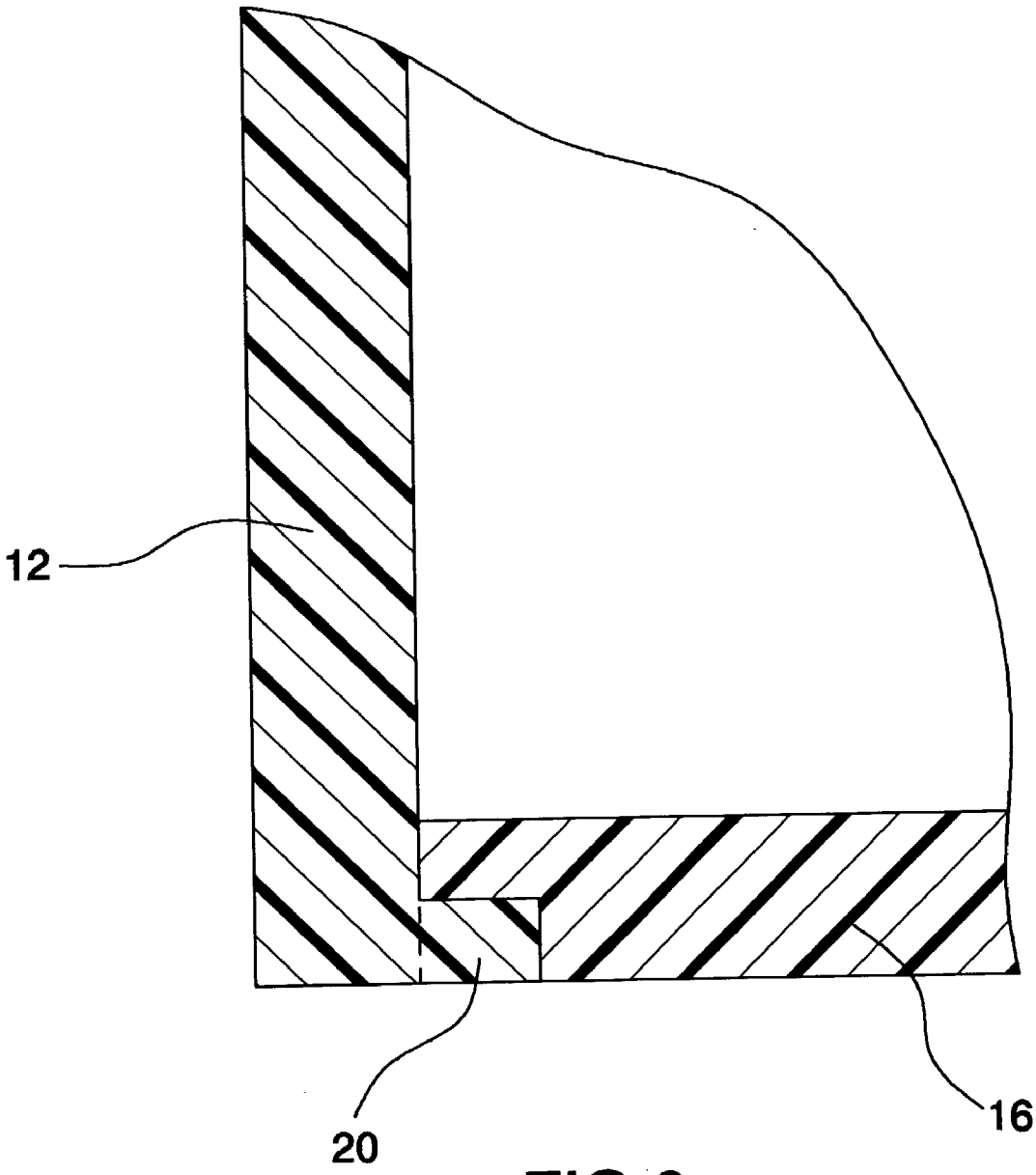
FIG. 6 is a close up cross sectional view of the collapsible storage container of the present invention taken along the line 6—6 in FIG. 3.

Referring finally to FIG. 6, a close up cross section view of the present embodiment of the invention is shown taken along the line 6—6 in FIG. 3. The foldable end panel 12 can be seen on edge, having a peripheral lip 20 on the inside surface at the bottom of the panel 12. The bottom panel 16 has a corresponding tongue that rests on the peripheral lip to support the weight of the loaded container.

In use, it can now be understood that the container 10 can be folded into a flat storage position by first moving the top panel retainers 26 one at a time and folding the top panels 18 down into the container 10, next folding the bottom panels 16 upwards into the container 10, and finally pushing inward on the foldable end panels 12 to flatten the entire structure. To open the container, the user would first pull apart from the recessed areas shown at the end of the flattened invention in FIG. 5 and straighten out the foldable end panels 12. Next, the user would fold down the bottom panels 16, and finally pull up the top panels 18 to an open position. At this point, the container is ready for use. Once can see that the container provides a rugged foldable container that is easily stored and transported, and much stronger and more resistant to the elements than cardboard.

While a preferred embodiment of the collapsible storage container has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable sturdy material such as metal, composite, cardboard, or a variety of wood may be used instead of the plastic panels described. The hinged connections can be formed of pliable material of all kinds, or a more pliable region of the same plastic used for the panels. Additionally, carry holes could be formed for convenient grasping on any of the surfaces.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A collapsible storage container having an interior comprising:

a pair of foldable end panels, each comprising two panel pieces hingedly connected together, each having a top, a bottom, an inside surface, and an outside surface;

a pair of side panels, each having a top and a bottom, an inside and an outside, said side panels connected to said foldable end panels at the ends thereof;

a pair of top panels, each one hingedly connected to the top of one of said side panels;

a pair of bottom panels, each one hingedly connected to one of said pair of side panels at said bottoms thereof;

wherein said collapsible storage container can be put in a first usable position by straightening said foldable end panels, folding down said bottom panels, and folding up said top panels, and also can be put in a second storage position by folding up said bottom panels, folding down said top panels, and folding said foldable end panels until said outside surfaces of said panel pieces-touch; and a top panel retainer installed on the inside surface of each of said foldable end panels, said top panel retainers positioned to engage said top panels when the container is in said first usable position and prevent said top panels from folding down into said interior of said container while permitting said top panels to be opened.

2. The collapsible storage container of claim 1, wherein said foldable end panels are each provided with a peripheral lip on the inside surface toward the bottom thereof, said peripheral lips supporting said bottom panels when the container is in said first usable position.

3. The collapsible storage container of claim 1, wherein said top panels are each provided with an upper and lower tongue at the side opposite the hinged connection to said side panels, said tongues engaging the tongue on the opposite panel when the container is in said first usable position.

4. The collapsible storage container of claim 1, wherein said bottom panels are each provided with an upper and lower tongue at the side opposite the hinged connection to said side panels, said tongues engaging the tongue on the opposite panel when the container is in said first usable position.

5. The collapsible storage container of claim 1, wherein said top panel retainer is a plurality of leaf springs, such that each of said leaf springs will move to a first supporting position when the container is in said first usable position, and will move to a second position flush within a recess on said inside surface of said foldable end panels when the container is in said second storage position.

6. The collapsible storage container of claim 1, further comprising:

handle holes formed in each of said top panels.

7. A collapsible storage container having an interior comprising:

a pair of foldable end panels, each comprising two panel pieces hingedly connected together, each having a top, a bottom, an inside surface, and an outside surface;

a pair of side panels, each having a top and a bottom, an inside and an outside, said side panels connected to said foldable end panels at the ends thereof;

a pair of top panels, each one hingedly connected to the top of one of said side panels;

a pair of bottom panels, each one hingedly connected to one of said pair of side panels at the bottom thereof;

a peripheral lip on said inside surface of said foldable end panels toward said bottom thereof, said peripheral lips supporting said bottom panels when the container is in said first usable position;

wherein said collapsible storage container can be put in a first usable position by straightening said foldable end panels, folding down said bottom panels, and folding up said top panels, and also can be put in a second storage position by folding up said bottom panels, folding down said side panels, and folding said foldable end panels until said outside surfaces of said panel pieces-touch; and a top panel retainer installed on the inside surface of each of said foldable end panels, said top panel retainers positioned to engage said top panels when the container is in said first usable position and prevent said top panels from folding down into said interior of said container while permitting said top panels to be opened.

8. The collapsible storage container of claim 7, wherein said top panels are each provided with an upper and lower tongue at the side opposite the hinged connection to said side panels, said tongues engaging the tongue on the opposite panel when the container is in said first usable position.

9. The collapsible storage container of claim 7, wherein said bottom panels are each provided with an upper and lower tongue at the side opposite the hinged connection to said side panels, said tongues engaging the tongue on the opposite panel when the container is in said first usable position.

10. The collapsible storage container of claim 7, wherein said top panel retainer is a plurality of leaf springs, such that each of said leaf springs will move to a first supporting position when the container is in said first usable position, and will move to a second position flush within a recess on said inside surface of said foldable end panels when the container is in said second storage position.

11. The collapsible storage container of claim 7, further comprising handle holes formed in each of said top panels.

12. A collapsible storage container having an interior comprising:

a pair of foldable end panels, each comprising two panel pieces hingedly connected together, each having a top, a bottom, an inside surface, and an outside surface;

a pair of side panels, each having a top and a bottom, an inside and an outside, said side panels connected to said foldable end panels at the ends thereof;

a pair of top panels, each one hingedly connected to the top of one of said side panels;

a pair of bottom panels, each one hingedly connected to one of said pair of side panels at the bottom thereof;

a peripheral lip on said inside surface of said foldable end panels toward said bottom thereof, said peripheral lips supporting said bottom panels when the container is in said first usable position;

a top panel retainer installed on the inside surface of each of said foldable end panels, said top panel retainers positioned to engage said top panels when the container is in said first usable position and prevent said top panels from folding down into said interior of said container while permitting said top panels to be opened;

wherein said collapsible storage container can be put in a first usable position by straightening the foldable end panels, folding down the bottom panels, and folding up said top panels, and also can be put in a second storage position by folding up the bottom panels, folding down said top panels and folding the foldable end panels until said outside surfaces of said panel pieces-touch.

13. The collapsible storage container of claim 12, wherein said top panels are each provided with an upper and lower tongue at the side opposite the hinged connection to said side panels, said tongues engaging the tongue on the opposite panel when the container is in said first usable position.

14. The collapsible storage container of claim 12, wherein said bottom panels are each provided with an upper and lower tongue at the side opposite the hinged connection to said side panels, said tongues engaging the tongue on the opposite panel when the container is in said first usable position.

15. The collapsible storage container of claim 12, further comprising:

handle holes formed in each of said top panels.

* * * * *